United States Patent [19]

Jacob

[11] Patent Number: 4,550,687

[45] Date of Patent: Nov. 5, 1985

[54] APPARATUS FOR OPERATING A HIGH PRESSURE BOILER

[76] Inventor: Karl A. Jacob, Industriestr. 2, D-8501 Feucht, Fed. Rep. of Germany

[21] Appl. No.: 552,134

[22] PCT Filed: Jan. 19, 1983

[86] PCT No.: PCT/DE83/00006

§ 371 Date: Sep. 21, 1983

§ 102(e) Date: Sep. 21, 1983

[87] PCT Pub. No.: WO83/02658

PCT Pub. Date: Aug. 4, 1983

[30] Foreign Application Priority Data

| | | | |
|---|---|---|---|
| Jan. 23, 1982 | [DE] | Fed. Rep. of Germany | 3202144 |
| Apr. 8, 1982 | [DE] | Fed. Rep. of Germany | 3213165 |
| Jun. 29, 1982 | [DE] | Fed. Rep. of Germany | 3224153 |
| Dec. 31, 1982 | [DE] | Fed. Rep. of Germany | 3248785 |

[51] Int. Cl.[4] ..... F22B 33/00

[52] U.S. Cl. ..... 122/1 C; 122/412; 165/159; 165/163

[58] Field of Search ..... 165/163, 141, 159, 96; 122/1 R, 1 C, 412, 428

[56] References Cited

U.S. PATENT DOCUMENTS

| | | | |
|---|---|---|---|
| 1,938,072 | 12/1933 | Karlsteen | 122/1 R |
| 1,939,415 | 12/1933 | Schaub | 122/1 R |
| 2,115,548 | 4/1938 | Artsay | 122/1 R |
| 3,367,309 | 2/1968 | Plagman, Jr. | 122/1 R |
| 4,202,406 | 5/1980 | Avery | 165/163 X |

*Primary Examiner*—Edward G. Favors

*Attorney, Agent, or Firm*—Browdy and Neimark

[57] ABSTRACT

The invention relates to a process and to a heat exchanger (8) intended in particular for performing the process, for operating a high-pressure boiler (1), having consuming units (3', 3'', 3''') connected to the high-pressure boiler (1), the condensate from which units is returned to a condensate tank (5). By means of a feed water pump (7), feed water is fed to the boiler (1) and the condensate and the feed water are then fed to a heat exchanger (8) upstream of the condensate tank (5). According to the invention, the hot condensate is fed to the free space of the heat exchanger (8), and the feed water which is to be heated is pumped to the heat exchanger (8), passed helically from the cold to the warm zone in the heat exchanger (8) and carried from the heat exchanger (8) into the boiler (1). As a result of this heating up of the feed water, the heat contained in the condensate becomes economically useable, resulting in substantial savings in heat medium for the boiler. The invention also relates to a heat exchanger (8), comprising a tank (5) with a pipeline disposed therein for one medium and a connection for the second medium. The process according to the invention and the apparatus according to the invention are particularly advantageously applicable to boiler installations for dry-cleaning establishments, laundries and so forth.

42 Claims, 10 Drawing Figures

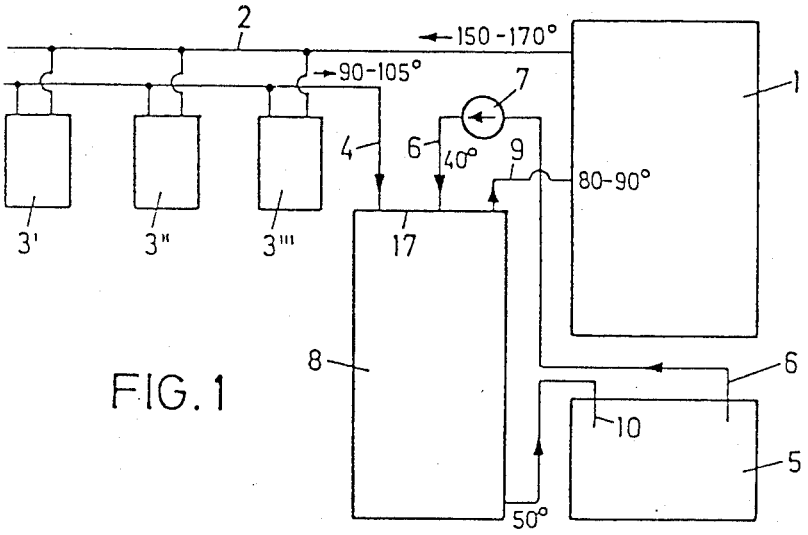
FIG. 1
FIG. 2
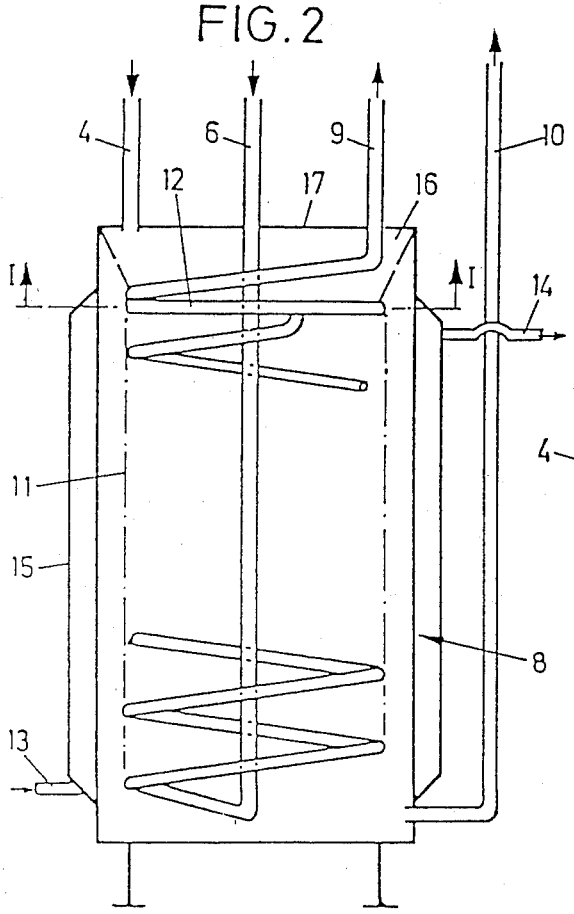
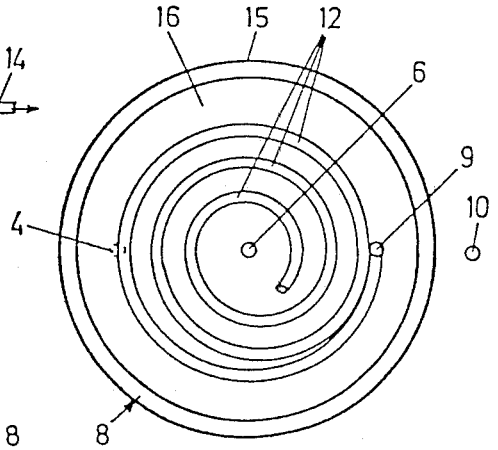
FIG. 3

FIG. 4
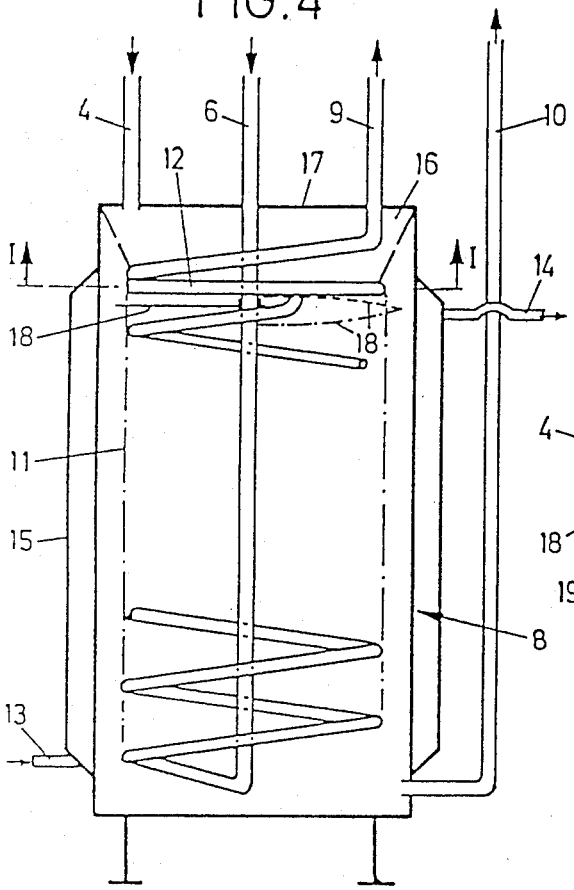
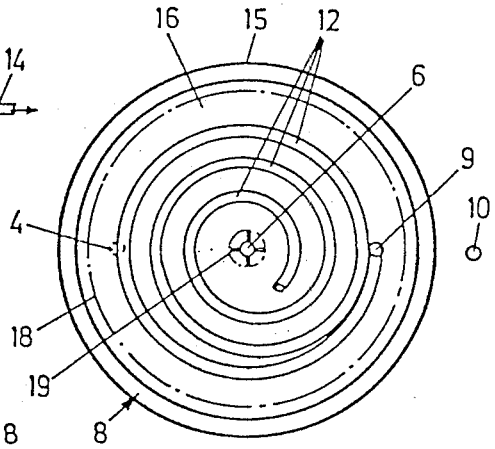
FIG. 5

APPARATUS FOR OPERATING A HIGH PRESSURE BOILER

BACKGROUND OF THE INVENTION

The invention relates to a process for operating a high-pressure boiler, in particular for dry-cleaners, laundries or the like, with consuming units which are connected to a high-pressure boiler and the condensate from which is returned to a condensate tank from which, by means of a feed water pump, feed water is fed to the boiler and the condensate and feed water are fed to a heat exchanger upstream of the condensate tank.

The invention also relates to equipment (a heat exchanger) which, in particular, is suitable and intended for carrying out the process.

Any high-pressure boiler installation is provided with a condensate return. The condensate consists of the mixture of wet steam at about 105° C. and a condensed hot water/steam mixture at about 90°–100° C.

The hot condensate is normally collected again in a condensate tank of the boiler installation. The boiler feed water pump then forces this hot water back into the superheated steam boiler, where renewed vaporisation takes place. Since water above 80°–85° C. causes difficulties with the pumps in the boiler, either very large condensate tanks are provided or the condensate is cooled additionally. On the other hand, this leads again to difficulties if the condensate is unduly cold (for example 60° C.), since soot then deposits on the boiler heating surfaces or boiler heating lines. It is also known to provide the condensate tanks with an exit gas branch, through which the wet steam can escape. It is the purpose of all these measures to cool down the very hot condensate, if possible, so that a condensate temperature of 60°–70° C. upstream of the pump is ensured.

High heat losses are incurred in such superheated steam boilers. A boiler unit of this type also requires a long running-up period on start-up, until the superheated steam has reached its necessary temperature.

SUMMARY OF THE INVENTION

It is therefore the object of the invention to improve the operating conditions of such a superheated steam boiler unit in such a way that the heat content of the condensate is utilised, the heating-up period of the boiler is shortened and damage to the lines and the boiler, for example due to precipitating $SO_2$, is avoided.

According to the invention, this object essentially is achieved when the hot condensate is fed to the free space of the heat exchanger, and the feed water to be heated is pumped into the heat exchanger, passed helically in the heat exchanger from the cold zone to the hot zone and is fed from the heat exchanger into the boiler.

In an advantageous manner, the process is run in such a way that the condensate flowing in at a temperature of about 90°–105° C. is cooled in the heat exchanger to about 50° C. and returned from the feed water tank to the heat exchanger at a temperature of about 40° C. and is fed at a temperature of about 90°–95° C. or higher to the boiler.

It is a further object of the invention to provide equipment, in particular a heat exchanger, by means of which the heat of the condensate from a boiler unit can be utilised in an optimum manner for increasing the temperature of the feed water, the greatest possible energy saving for the operating of the boiler can be achieved and can be adapted in a simple manner to varying operating conditions or varying sizes of the high-pressure boiler, for example, higher output, and the performance of the heat exchanger can also be controlled as a function of the condensate rate.

According to the invention, this object is achieved in a heat exchanger which is particularly suitable for carrying out the process according to the invention and which comprises a vessel with a pipe, disposed therein, for one medium and a connection for the second medium, when connections, ending in the cover of the vessel, for a first condensate line, a feed water feed line and a feed water discharge line as well as a second condensate line are provided, and when a feed water coil arranged between the feed water feed line and the feed water discharge line and extending over the height of the vessel is provided, the feed water feed line extending down to the lowest point of the feed water coil, and the feed water discharge line starting at the highest point of the feed water coil.

The heat exchanger according to the invention is disposed in the condensate circulation downstream of the feed water pump and upstream of the boiler inlet.

This design has the advantage that the hot fresh condensate is cooled down and, on the other hand, the boiler feed water of about 60° C., before entering the boiler, is heated up in the feed water coil by the fresh condensate to about 90°–95° C. and even higher.

According to an advantageous illustrative embodiment of the invention, the condensate line is connected to consuming units and leads to a feed water tank, the feed water feed line being connected to a pump and the feed water discharge line being connected to a high-pressure boiler.

According to a further development of the invention, the upper end of the feed water coil has the shape of a shallow coil. As a result, the heat content of the condensate, present in the fresh condensate, is utilised in an optimum manner. According to a first illustrative embodiment, the shallow coil can have a plane shape or, according to modifications, it can have a shape which is concave or convex in the upward direction.

Additionally, according to a further feature of the invention, an impingement baffle (forced jet baffle) which is, for example, conical, starts from the cover and extends down to the plane of the shallow coil, can be fitted in the vessel. As a result, the wet steam is guided to that point of the feed water coil which is located at the heat exchanger inlet. Thus, the temperature of the boiler feed water is once more raised by about 5° C.

To enhance the utilisation of the heat content of the condensate further, a re-circulation baffle is provided below the shallow coil, according to a further development of the invention.

This design has the substantial advantage that the hot fresh condensate develops intensive turbulence in the zone of the shallow spiral and releases a major part of its heat content to the shallow spiral. The fresh condensate flowing in is vaporised, flows first around the shallow coil on all sides and strikes the re-circulation baffle, causing the strong turbulence.

In an advantageous manner, according to an illustrative embodiment of the invention, the re-circulation baffle is disposed on the feed water feed line.

According to a simple illustrative embodiment of the invention, the re-circulation baffle has a plane shape.

According to a modification of the invention, the re-circulation baffle has a shape which is concave in the direction of the cover.

In a yet further modification of the invention, the re-circulation baffle has a shape which is convex in the direction of the cover.

Finally, for example with a horizontal arrangement of a heat exchanger, the bottom of the heat exchanger can also act as a re-circulation baffle.

According to a further feature of the invention, the re-circulation baffle can be profiled, independently of its spatial shape. The profiling can result from raises or recesses which can have the form of points or lines.

Preferably, the diameter of the re-circulating baffle is selected to be smaller than the internal diameter of the vessel. In this illustrative embodiment, the wet steam thus flows from the centre of the heat exchanger approximately radially outwards and downwards between the re-circulation baffle and the wall of the heat exchanger.

In yet a further embodiment of the invention, the height of the re-circulation baffle is adjustable in order to make possible an adaptation to the throughput of wet steam.

In order to design the heat exchanger of the type described above in such a way that it can readily be adapted to varying operating conditions or varying sizes of the high-pressure boiler, for example, higher output, it is envisaged according to the invention that at least one pipe section is provided which can be connected to the vessel and can be closed by the cover provided with connections for the condensate line, a first feed water line and a second feed water line and which has a shallow feed water coil, an impingement baffle and a re-circulation baffle as well as means for connecting the feed water lines and the shallow feed water coil of the pipe section to the feed water line of the shallow coil of the vessel.

Due to this design, according to the invention, of pipe sections which can be additionally fitted and have a shallow coil, ready adaptation to varying operating parameters of the particular high-pressure boiler to be operated is made possible in an advantageous manner.

According to a further development of the invention, the re-circulation baffle in the pipe section can be of a design analogous to that of the re-circulation baffle in the heat exchanger vessel itself. In particular, in an advantageous manner, the re-circulation baffle is disposed on the feed water feed line of the pipe section. According to a first illustrative embodiment, the recirculation baffle has a plane shape.

In order to enable the re-circulation baffle to direct the wet steam upwards again, the re-circulation baffle advantageously has a shape which is concave in the direction of the cover.

If, however, a certain proportion of the wet steam is to be fed to the second plane shallow coil in the vessel, it is advantageous if the re-circulation baffle has a shape which is convex in the direction of the cover.

In yet a further design, the re-circulation baffle can have a profiled shape.

In general, it is advantageous if the diameter of the re-circulation baffle is smaller than the internal diameter of the pipe section. In conjunction with the impingement baffle, it is appropriate if the diameter of the re-circulation baffle is greater than the free internal diameter of the impingement baffle.

In yet a further embodiment of the invention, the height of the re-circulation baffle in the pipe section can also be adjustable for adaptation to the throughput of wet steam. In an advantageous manner, drive means for height adjustment means of the re-circulation baffle or baffles are provided. The drive means for the height adjustment means can be controlled electrically or electronically.

In the heat exchanger according to the invention, the return condensate from the consuming units is, due to the special type of feeding, separated into the two phases, gas and liquid, namely wet steam and hot water. As a result, a primary (gas) zone and a secondary (water) zone is formed in the heat exchanger. The generation of steam in the specially shaped primary zone leads to a high k value. In the secondary zone, the boiler feed water is pre-heated. This zone is located in the lower third of the heat exchanger, namely in the liquid region.

In order to increase the efficiency of this heat exchanger even further, and in order to obtain a further energy saving for the operation of the boiler, a non-return flap is disposed in the condensate line from the heat exchanger to the condensate tank, according to a further development of the invention.

It is particularly advantageous if the condensate line is laid out as a riser leading to the condensate tank arranged at a level about the heat exchanger.

The result of the design according to the invention is that a back pressure is generated which ensures the functioning of the heat exchanger. Since the heat exchanger is operated in the pressure range of $\pm 0.2$ bar, the non-return flap prevents sucking-back of the thermally spent condensate.

Additionally, the heat exchanger according to the invention can be used for the production of service water. For this purpose, it is advantageous if a jacket containing service water, with a service water feed connection and a service water discharge connection, is arranged around the heat exchanger.

To increase the utilisation of the heat content of the condensate even further, it is advantageous if the condensate line is heat-insulated together with the vessel.

BRIEF DESCRIPTION OF THE DRAWINGS

Further details, advantages and features of the invention are explained in more detail by reference to the illustrative embodiments according to the drawing, in which;

FIG. 1 diagrammatically shows a sketch representation of a superheated steam boiler installation according to the invention;

FIG. 2 shows a longitudinal section through a heat exchanger according to the invention;

FIG. 3 shows a cross-section at the level of the plane coil along the section I—I in FIG. 2;

FIG. 4 shows a longitudinal section through an illustrative embodiment of a heat exchanger according to the invention;

FIG. 5 shows a cross-section at the level of the plane coil along the section I—I in FIG. 4;

DETAILED DESCRIPTION OF THE INVENTION

Figure 6:
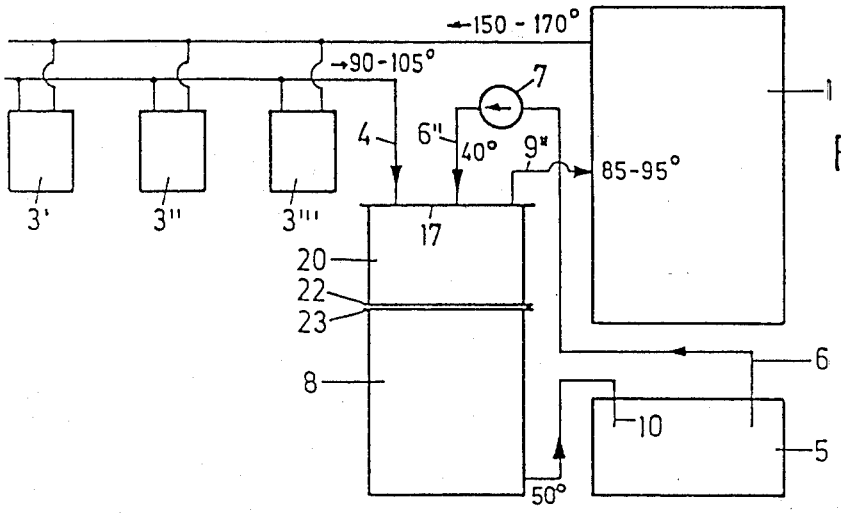
FIG. 6 shows a sketch representation of a superheated steam boiler installation, analogous to FIG. 1, with a second illustrative embodiment of a heat exchanger.

FIG. 1 diagrammatically shows a high-pressure boiler installation, in which the process according to the invention is carried out.

An installation of this type comprises a high-pressure boiler 1 which delivers high-pressure steam at a temperature of about 150°-170° C. and under a pressure of about 5-7 bar.

The superheated steam is passed via a high-pressure steam line 2 to consuming units 3',3'',3'''. When the boiler unit is used in a dry-cleaning establishment or in a laundry, such consuming units can be ironing machines, steaming dummies, steaming booths or the like. From the consuming units 3',3'',3''' the hot condensate is returned via a first condensate line 4. Normally, this line 4 leads to a feed water (condensate) tank 5 in which the condensate cools. From the condensate tank 5, the feed water is fed back to the high-pressure boiler 1 by means of a feed water pump 7.

In the process according to the invention, the condensate is passed through a heat exchanger 8, before it enters the condensate tank 5. In the heat exchanger 8, the heat of the condensate, flowing back at a temperature of about 90°-105° C., is transferred to the feed water, so that, on leaving the heat exchanger 8, the condensate has a temperature of about 50° C. and enters the feed water tank 5 with this temperature. Due to the cooling in the tank 5, the temperature of the feed water downstream of the pump 7 falls to about 40° C. Due to the heat exchange in the exchanger 8, the temperature of the boiler water is then raised again to about 80°-105° C.

Since the feed water entering the boiler 1 is already at a relatively high temperature, the quantity of heat required to generate steam at 150°-170° C. is reduced. Measurements have shown that the required heating energy is at least 20% lower.

An additional advantage results from the fact that, on starting, the boiler 1 reaches its operating temperature, and can deliver superheated steam, much sooner. The hot fresh condensate cools due to the transfer of heat to the condensate being pumped through. The forced flow, effected by the pump 7, through the heat exchanger 8 makes it possible to utilise the heat of the heat content of the hot condensate from the return line 4 advantageously for heating up the feed water for the boiler 1.

FIG. 2 shows a longitudinal section through a heat exchanger 8 according to the invention. This heat exchanger 8 consists generally of a cylindrical vessel with a cover part 17 into which lead the condensate line 4 and a feed water feed line 6. The cooled condensate is passed by means of a second condensate line 10 to a feed water tank 5. The feed water feed line 6 extends from the cover 17 up to the lowest point of the heat exchanger 8 and then runs helically as a coil up to a feed water discharge line 9 which is likewise disposed on the cover 17. The result of disposing the condensate line 4 on the cover 17 is that the hottest condensate strikes the final turns of a hot water coil 11 shortly before the latter emerges from the heat exchanger 8.

Since the heat exchanger 8 is arranged in the circulation downstream of the pump 7 and upstream of the boiler 1, a particularly advantageous utilisation of the heat of the condensate is obtained, because this causes a forced flow of the boiler feed water to the heat exchanger 8.

An even further increase in the temperature of boiler feed water pumped through can be obtained by providing the feed water coil 11 at its upper end with an additional feed water coil 12, which is plane or is convex or concave in the upward direction, or a shallow coil. When such an additional shallow coil is used, it is advantageous to provide an impingement baffle 16 (forced jet baffle) starting from the cover 1. This impingement baffle 16 can be of a disc-shaped or annular design. Due to this impingement baffle 16, the wet steam is passed to those points of the coils 11 or 12 which are at the heat exchanger inlet. The use of a plane shallow coil 12 and an impingement baffle 16 results in a further increase of the temperature of the boiler feed water by about 5° C.

The allocation of the individual lines and coils can be seen from FIG. 3, in a cross-section along the line I—I of FIG. 2, in the plane of the shallow coil 12.

The results of the increase in temperature of the boiler feed water to about 80°-105° C. are that, on the one hand, the boiler 1 can assume full operation within about 15-30 minutes and that the sulphur fraction in the fuel oil to the boiler always remains gaseous, so that no $SO_2$ is precipitated and hence sooting-up of the heating surfaces of the boiler 1 is also avoided.

In the illustrative embodiment of a heat exchanger according to the invention, according to FIGS. 4 and 5, a re-circulation baffle 18 is provided below the shallow coil 12 in order to increase the residence time of the fresh condensate in the region of the plane coil 12 or to store fresh condensate. This preferably circular re-circulation baffle 18 is advantageously located on the feed water feed line 6. The re-circulation baffle 18 can here be welded to the line 6. It can also be placed or suspended on suitable struts 19. According to an advantageous further development, the height of the re-circulation baffle 18 can also be adjustable. This makes it possible to adapt the gap between the impingement baffle 16 and the re-circulation baffle 18 to the particular throughput of fresh condensate.

The arrangement is here made in such a way that the diameter of the re-circulation baffle 18 is smaller than the internal diameter of the heat exchanger. This leads to a gap between the shell of the heat exchanger and the re-circulation baffle 18, so that the cooled condensate can drop down through this gap.

As shown in FIG. 4 on the left, the re-circulation baffle 18 can have a plane shape, or its shape can be convex or concave in the direction of the cover 17, as shown in FIG. 4 on the right.

FIG. 5 shows, in a cross-section along the line I—I of FIG. 4 in the plane of the shallow coil 12, the allocation of the individual lines and coils and of the impingement baffle 16 and re-circulation baffle 18.

Figure 7:
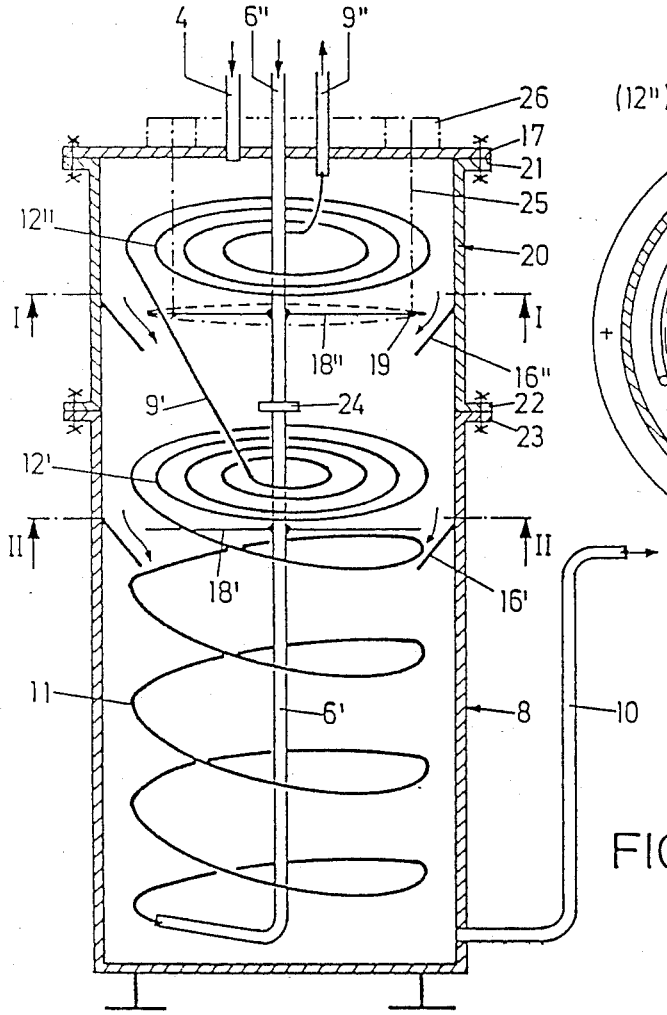
FIG. 7 shows a longitudinal section through a further illustrative embodiment of a heat exchanger according to the invention.
Figure 8:
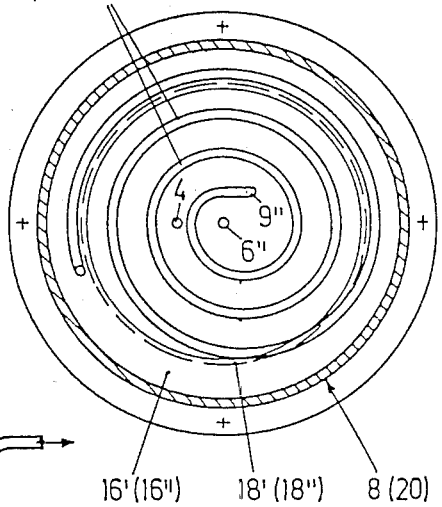
FIG. 8 shows a cross-section at the level of the plane coil along the section I—I or II—II in FIG. 7.

According to a further illustrative embodiment of the invention, according to FIGS. 6 to 8, a second heat exchanger for adaptation to the particular output of the high-pressure boiler 1 (FIG. 6) is arranged on the vessel 8 of the heat exchanger in such a way that a pipe section 20 results, the pipe section 20 and the vessel 8 being mutually joined via ring flanges 22, 23.

In FIG. 7, such a heat exchanger 8, according to the invention, in conjunction with the pipe section 20 is shown in a longitudinal section.

The additional heat exchanger part, provided according to the invention, is disposed in a pipe section 20. This pipe section 20 is provided with an upper ring flange 21 to which a cover 17 is connected. The condensate line 4 and a feed water feed line 6″ end in the cover part 17. Through a feed water discharge line 9″, likewise disposed on the cover 17, the feed water is passed back to the boiler 1. The cooled condensate is passed to the feed water tank 5 by means of a condensate line 10 arranged on the vessel 8. The feed water feed line 6″ or 6′ extends from the cover 17 down to the lowest point of the vessel 8 and then runs helically as a coil up to the feed water discharge line 9′ or 9″. The result of arranging the condensate line 4 on the cover 17 is that the hottest condensate strikes the end turns of a shallow feed water coil 12″, disposed in the pipe section 20, shortly before this coil emerges from the heat exchanger pipe section 20.

The upper end of the feed water coil 11 in the vessel 8 also has the shape of a plane or concave or convex shallow feed water coil 12′ which is connected to a shallow coil 12″ in the pipe section 20. A re-circulation baffle 18″ is also provided in the pipe section 20, as is an impingement baffle 16″.

For the sake of clarity or intelligibility, the feed water coil 11 and the approximately plane shallow feed water coils 12′ and 12″ are shown in FIG. 7 to be inclined, whilst in reality they are in an approximately horizontal position in the vessel 8 or pipe section 20 respectively.

The impingement baffles 16′, 16″ guide the wet steam to those points of the coil 11 or 12′, 12″ which are located at the boiler inlet. This use of plane shallow coils 12′, 12″ and impingement baffles 16′, 16″ results in a further increase in the temperature of the boiler feed water by about 5° C.

The re-circulation baffles 18′, 18″ provided below the shallow coil 12′ or 12″ respectively increase the residence time of the wet steam in the region of the plane coils 12′ or 12″.

These preferably circular re-circulation baffles 18′, 18″ are appropriately each located on the feed water feed line 6′ or 6″ respectively. The particular re-circulation baffle 18′ or 18″ can here be welded to the lines 6′ or 6″. It can also be placed or suspended on suitable struts 19. According to an advantageous further development, the height of each re-circulation baffle 18′ or 18″ can also be adjustable. This makes it possible to adapt the gap between the associated impingement baffle 16′ or 16″ and re-circulation baffle 18′, 18″ to the particular throughput of wet steam.

The design can here be such that height adjustment means 25 are provided which are actuated by drive means 26. The control of the drive means 26 can here be effected by electronic or electrical elements which control the drive means 26 as a function of the rate of wet steam. For example, a turbine can be provided on the condensate line 4 for measuring the rate of the wet steam or condensate.

The re-circulation baffles 18′ and 18″ can here be designed in such a way that their diameter is smaller than the internal diameter of the vessel 8 or of the pipe section 20 respectively. Thus, there is in each case a gap between the shell of the vessel 8 or the pipe section 20 and the re-circulation baffle 18′ or 18″ respectively, so that the cooled condensate can drop down through this gap.

The shape of the particular re-circulation baffle 18′, 18″ can be plane, as shown in FIG. 7, or it can be convex or concave in the direction of the cover 17.

The additional heat exchanger part, according to the invention, in the pipe section 20 makes it possible to adapt the heat exchanger to the particular operating conditions of the associated high-pressure boiler or the installation. It is also possible to fit several pipe sections 20 each with a plane shallow coil axially in series. For this purpose, it is only necessary to join up the flanges in each case and to bolt the cover 17 to the uppermost pipe section 20. The feed water lines 6′ or 6″ of the individual pipe sections 20 and of the heat exchanger part 8 are joined to one another by any desired connection means 24 known per se.

FIG. 8 shows, in a cross-section along the lines I—I or II—II of FIG. 7 in the planes of the shallow coils 12′, 12″ the allocation of the individual lines and coils and of the impingement baffles 16′, 16″ and re-circulation baffles 18′, 18″.

Figure 9:
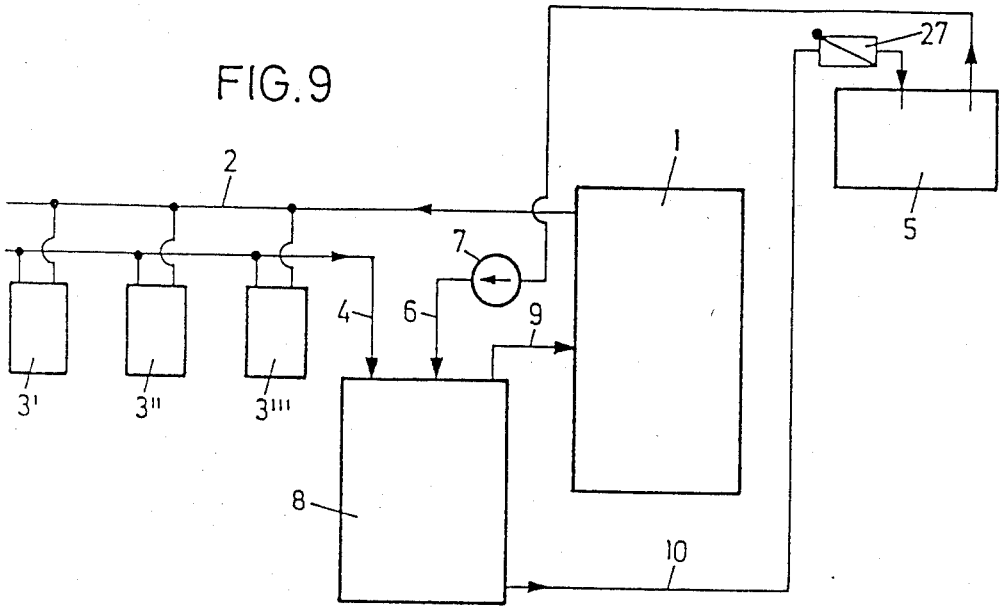
FIG. 9 shows a sketch representation of a superheated steam boiler installation according to the invention, analogous to FIG. 1, with a further illustrative embodiment of a heat exchanger.
Figure 10:
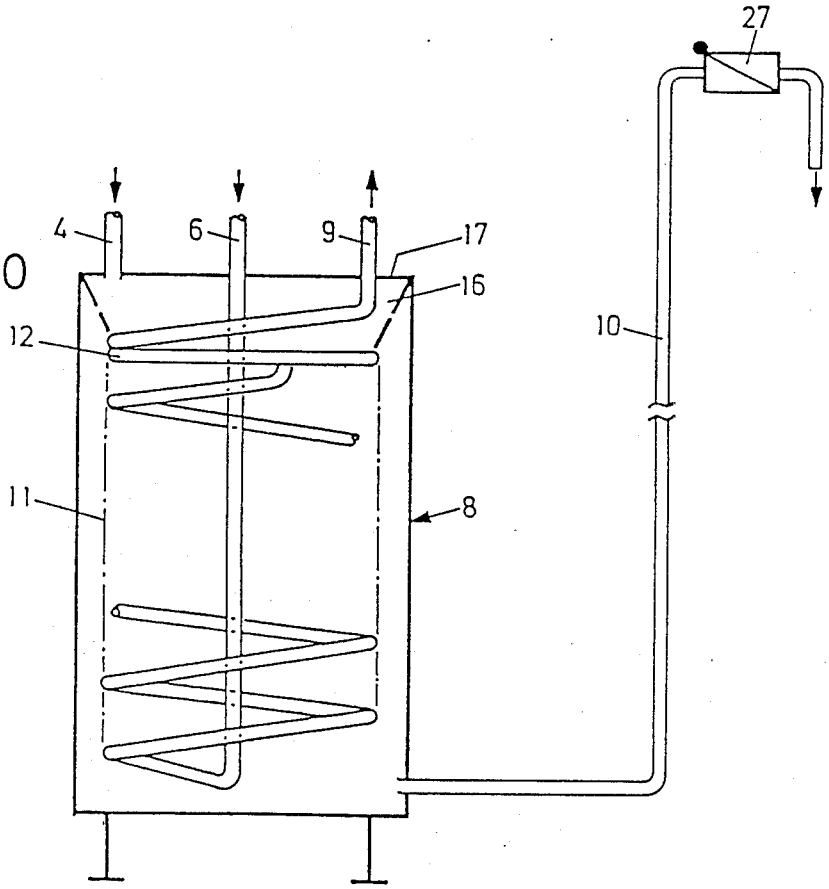
FIG. 10 shows a longitudinal section through the illustrative embodiment of a heat exchanger according to FIG. 9.

FIGS. 9 and 10 show a further illustrative embodiment in which, due to an appropriate arrangement of the lines, the efficiency of the heat exchanger 8 is further increased, and a further energy saving can be achieved in the operation of the boiler 1.

In FIG. 9, an installation designed according to the invention is shown diagrammatically, and in FIG. 10 a heat exchanger 8 which is further developed according to the invention. This heat exchanger 8 according to the invention is shown in longitudinal section in FIG. 10. As in the other illustrative embodiments, the cooled condensate is passed by means of a second condensate line 10 to the feed water tank 5. The second condensate line 10, leading upwards, has a level difference of about 2.5 m and is preferably provided with a non-return flap 27 in the upper zone.

The result of providing the non-return flap 27 in the line 10 is that, when the heat exchanger 8 is operated in the vacuum region, the thermally spent condensate is not sucked back into the heat exchanger 8 and the gas volume of the primary zone remains unchanged. The back pressure advantageous to the functioning of the heat exchanger is generated due to the condensate line 10 being taken upwards and due to the non-return flap 27. The subdivision, thus resulting, of the heat exchanger into two zones makes is possible for the condensate arising to be let down suddenly, that is to say it expands and is enlarged to give a gas volume, in the sense of a gas phase. At the same time, a large part of the heat content is suddenly removed from the gas volume by the contact with a large heat-removing surface, namely the feed water coil 11. The steam collapses to about 1/1000 of its volume, generating a vacuum of down to −0.4 bar in the entire condensate line system. As a result, feeding of the condensate to the heat exchanger is accelerated.

The pulsed mode of operation of the heat exchanger in the plus and minus pressure ranges makes it possible to build up the pressure zone and hence to store fresh condensate which arises at non-uniform rates. Since pressure is built up to a maximum of about 0.4 bar due to the back pressure principle and due to taking the condensate line upwards by about 2.5 m on the outlet side, the primary zone can at times be compared with a lowpressure boiler.

The utilisation of the heat content of the condensate can be even further increased by surrounding the heat exchanger 8 with an additional jacket 15 (FIG. 2 or 3) which forms a service water container. The service water can be fed in through a service water feed connection 13 and can be withdrawn from the service water cylinder through a service water discharge line 14.

An even further increase in the heat utilisation results if the condensate line 4 as well as the heat exchanger are heat-insulated.

The invention is not restricted to the illustrative embodiments shown and described. It also comprises all expert modifications and further developments and partial combinations and sub-combinations of the features and measures shown or described.

I claim:

1. Apparatus for improving the efficiency of a high-pressure steam boiler, especially for dry-cleaning plants, laundries or the like, including consuming units connected to the high-pressure steam boiler, and in which condensate from the consuming units is returned to a feed water reservoir contained in a condensate tank, the feed water being pumped from the condensate tank to the boiler, said apparatus comprising:

a heat exchanger;

means for feeding the condensate to the heat exchanger through a line located up-stream from the condensate tank, the feed water from the condensate tank being pumped into the heat exchanger through a further pipe and being fed from the heat exchanger to the boiler, said heat exchanger consisting of a second tank with one line disposed therein for one medium and a connection for a second medium, said second tank including a cover in which are disposed connections for a condensate line, a feed water feed line and a feed water discharge line, said heat exchanger housing therein a feed water coil, said coil extending over the height of the tank and being disposed between the feed water feed line and the feed water discharge line, said feed water line extending to the lowest point of the feed water coil and said feed water discharge line extending from the highest point of the feed water coil, said condensate line supplying hot condensate opening into the free space of the tank opposite the upper end of the feed water coil, said second tank including an impingement baffle, said baffle defining means for diverting the inflow of hot condensate toward the feed water coil, and means for feeding the feed water to be heated into said coil from a cold zone, to a hot zone, of said second tank.

2. The apparatus according to claim 1, characterised in that the upper end of the feed water coil has the shape of a shallow coil.

3. The apparatus according to claim 2, characterised in that the shallow coil has a planar shape.

4. The apparatus according to claim 2, characterised in that the shallow coil has a shape which is concave in the upward direction.

5. The apparatus according to claim 2, characterised in that the shallow coil has a shape which is convex in the upward direction.

6. A heat exchanger according to claim 3, characterised in that, in the vessel, said impingement baffle extends from the cover down to the plane of the shallow coil.

7. The apparatus according to claim 2, characterised in that a re-circulation baffle is provided below the shallow coil.

8. The apparatus according to claim 7, characterised in that the re-circulation baffle is disposed on the feed water line.

9. The apparatus according to claim 7, characterised in that the re-circulation baffle has a plane shape.

10. The apparatus according to claim 8, characterized in that the re-circulation baffle has a plane shape.

11. The apparatus according to claim 7, characterised in the the re-circulation baffle has a shape which is concave in the direction of the cover.

12. The apparatus according to claim 8, characterised in the the re-circulation baffle has a shape which is concave in the direction of the cover.

13. The apparatus according to claim 7, characterised in that the re-circulation baffle has a shape which is convex in the direction of the cover.

14. The apparatus according to claim 8, characterised in that the re-circulation baffle has a shape which is convex in the direction of the cover.

15. The apparatus according to claim 7, characterised in that the re-circulation baffle is profiled.

16. The apparatus according to claim 8, characterised in that the re-circulation baffle is profiled.

17. The apparatus according to claim 7, characterised in that the diameter of the re-circulation baffle is smaller than the internal diameter of the vessel.

18. The apparatus according to claim 8, characterised in that the diameter of the re-circulation baffle is smaller than the internal diameter of the vessel.

19. The apparatus according to claim 7, characterised in the the re-circulation baffle is disposed such that the height at which it is located is adjustable.

20. The apparatus according to claim 8, characterised in that the re-circulation baffle is disposed such that the height at which is is located is adjustable.

21. The apparatus according to claim 7, characterised by at least one pipe section which can be connected to the vessel and can be closed by the cover provided with connections for the first condensate line, the first feed water line and the second feed water line, and which has a shallow feed water coil, impingement baffle and re-circulation baffle, and by means for connecting the feed water lines and the shallow feed water coil of the pipe section to the feed water line of the shallow coil of the vessel.

22. The apparatus according to claim 19, characterised by at least one pipe section which can be connected to the vessel and can be closed by the cover provided with connections for the first condensate line, the first feed water line and the second feed water line, and which has a shallow feed water coil, impingement baffle and re-circulation baffle, and by means for connecting the feed water lines and the shallow feed water coil of the pipe section to the feed water line of the shallow coil of the vessel.

23. The apparatus according to claim 20, characterised by at least one pipe section which can be connected to the vessel and can be closed by the cover provided with connections for the first condensate line, the first feed water line and the second feed water line, and which has a shallow feed water coil, impingement baffle and re-circulation baffle, and by means for connecting the feed water lines and the shallow feed water coil of the pipe section to the feed water line of the shallow coil of the vessel.

24. The apparatus according to claim 21, characterised in that the re-circulation baffle is disposed on the feed water feed line of the pipe section.

25. The apparatus according to claim 22, characterised in that the re-circulation baffle is disposed on the feed water feed line of the pipe section.

26. The apparatus according to claim 23, characterised in that the re-circulation baffle is disposed on the feed water feed line of the pipe section.

27. The apparatus according to claim 21, characterised in that the diameter of the re-circulation baffle is smaller than the internal diameter of the pipe section.

28. The apparatus according to claim 22, characterised in that the diameter of the re-circualtion baffle is smaller than the internal diameter of the pipe section.

29. The apparatus according to claim 23, characterised in that the diameter of the re-circulation baffle is smaller than the internal diameter of the pipe section.

30. The apparatus according to claim 21, characterised in that the diameter of the re-circulation baffle is greater than the free internal diameter of the impingement baffle.

31. The apparatus according to claim 22, characterised in that the diameter of the re-circulation baffle is greater than the free internal diameter of the impingement baffle.

32. The apparatus according to claim 23, characterised in that the diameter of the re-circulation baffle is greater than the free internal diameter of the impingement baffle.

33. The apparatus according to claim 21, characterised in that one of the re-circulation baffles in the pipe section includes means for adjusting the height at which it is disposed.

34. The apparatus according to claim 22, characterised in that one of the re-circulation baffles in the pipe section includes means for adjusting the height at which it is disposed.

35. The apparatus according to claim 23, characterised in that one of the re-circulation baffles in the pipe section includes means for adjusting the height at which it is disposed.

36. The apparatus according to claim 33, characterised by drive means for the height adjusting means of the re-circulation baffle.

37. The apparatus according to claim 34, characterised by drive means for the height adjusting means of the re-circulation baffle.

38. The apparatus according to claim 35, characterised by drive means for the height adjusting means of the re-circulation baffle.

39. The apparatus according to claim 1, characterised in that a non-return flap is disposed in the second condensate line extending from the heat exchanger to the condensate tank.

40. The apparatus according to claim 1, characterised in that the second condensate line comprises a riser leading to the condensate tank arranged at a level higher than that of the heat exchanger.

41. The apparatus according to claim 1, characterised by a service water container jacket surrounding the container, including a service water feed connection and a service water discharge connection.

42. The apparatus according to claim 1, characterised in that the first condensate line is heat-insulated.

* * * * *